United States Patent [19]

Mueller et al.

[11] 4,182,998

[45] Jan. 8, 1980

[54] EXTERNALLY ADJUSTABLE ELECTROMAGNETIC RELAY

[75] Inventors: Erwin Mueller, Munich; Günther Schwab, Neuried, both of Fed. Rep. of Germany

[73] Assignee: Siemens Aktiengesellschaft, Berlin & Munich, Fed. Rep. of Germany

[21] Appl. No.: 904,598

[22] Filed: May 10, 1978

[30] Foreign Application Priority Data

May 23, 1977 [DE] Fed. Rep. of Germany ..... 2723219

[51] Int. Cl.[2] ..... H01H 51/27

[52] U.S. Cl. ..... 335/151; 335/86; 335/153

[58] Field of Search ..... 335/151, 153, 154, 152, 335/86, 212, 298, 67, 81, 96, 132, 155, 176, 194, 198, 197; 29/155.5

[56] References Cited

U.S. PATENT DOCUMENTS

| | | | |
|---|---|---|---|
| 3,242,557 | 3/1966 | Ellwood | 335/151 |
| 3,477,045 | 11/1969 | Sauer | 335/151 |
| 3,587,011 | 6/1971 | Kurz | 335/151 |
| 3,711,749 | 1/1973 | Koblents et al. | 335/151 |

*Primary Examiner*—Harold Broome

*Attorney, Agent, or Firm*—Hill, Van Santen, Steadman, Chiara & Simpson

[57] ABSTRACT

A magnetically adjustable relay which may have an internally positioned sealed contact system is disclosed wherein the switching element of the contact system is elongated and has one end affixed to an elongated ferromagnetic adjusting plate. The adjusting plate is attached to the coil body by means of torsional cross pieces or bars. The position of the adjusting plate within the coil body can be adjusted by means of an exteriorly applied magnetic field which deforms the cross bars.

13 Claims, 6 Drawing Figures

EXTERNALLY ADJUSTABLE ELECTROMAGNETIC RELAY

BACKGROUND OF THE INVENTION

1. Field of the Invention

This invention relates to relays and more particularly to an adjustable relay where contact spacing can be set by an externally applied magnetic field.

2. Prior Art

This invention is directed to that type of electro-magnet relay which has a switching element which is mounted at one end internally of a relay body, which may be a coil body. The switching element is elastic or resilient such that its free end can move to cooperate with at least one other switching member to effectuate a contact. Such a switching element can, for example, be a contact tongue, an arm, an armature, a contact spring or an armature contact or any other known variant.

Such relays often have sealed contact systems where the switching element cannot be reached after assembly of the relay. Thus, it is not possible, or at least extremely difficult, to insert tools into the switching area for the purpose of adjusting the setting of the switching element after assembly.

While it has been suggested to utilize an externally applied magnetic field to properly position the switching element, because of the desired resilient properties of the switching element, such methods have not been entirely practical.

SUMMARY OF THE INVENTION

More recently, it has been suggested to attach the resilient switching element to an easily deformable adjusting plate and to suspend the adjusting plate interior of the switching space. Thereafter, application of an externally applied magnetic force can cause a deformation of the adjusting plate resulting in a repositioning of the switching element. Thus, for example, the switching element may be elongated having a free end functioning as the contact make-break point with an opposite end affixed to the adjusting plate. The adjusting plate may extend in parallel to the switching element and may have one end thereof affixed to the relay body. By providing for a specific bending point intermediate the ends of the adjusting plate, the application of an externally sourced magnetic field will cause the adjusting plate to bend around the bending point. In this manner, the contact end of the switching element can be accurately positioned.

It is a primary object of the present invention to further the development of such magnetically adjustable relays by providing a resilient switching element which is attached in spaced relation to its contact end to an adjusting plate which in turn is carried by the relay body. The adjusting plate is provided with a specifically designed support which facilitates its magnetic adjustment within the relay housing.

It is a further object of this invention to provide, within the design of the adjusting plate, a simplified mounting system for attachment of the adjusting plate in position in the relay housing which cooperates with the bending design of the adjusting plate to the end that the assembly is both simple to produce and assemble while insuring a proper magnetic adjustment within tight tolerance limits.

These objectives are obtained according to this invention in that the adjusting plate is provided with two laterally extending torsion members which form a swivel axis within the relay housing. The adjusting plate is supported within the switching space of the housing by enclamping the torsion members (hereinafter, torsion bars) to the relay body. Thus, the torsion bars provide not only support of the adjusting plate within the switching space, but also a bending point for the adjusting plate.

Thus, according to this invention, an elongated adjusting plate is suspended by two torsion bars which can be advantageously deformed by means of the application of an external magnetic field which will cause movement of the adjusting plate such that the torsion bar will function as swivel axes.

The magnetic forces can be particularly well applied for precise adjustment if the torsion bars are positioned approximately at the longitudinal center of the adjusting plate.

Moreover, in the preferred embodiment illustrated, the torsion bars can be attached to internal side walls of the relay housing by having the torsion bars formed integral with guide support members received in grooves in the internal side walls of the housing. Moreover, the adjusting plate may be formed with a fork-like end with the torsion bars interconnecting outside guide supports with a central adjusting plate member, the outside guides being received in the grooves in a relatively snug relationship free from play.

A particularly advantageous design from a production standpoint exists when the adjusting plate with its torsion bars and guide portions which interfit in the grooves are all produced from a common sheet metal strip. The switch tongue or resilient switching element is then attached at one of its ends to the adjusting plate by means such as welding. The end of the adjusting plate to which the switching element is attached is expediently off-set by means such as stamping so that the switching element will be spaced from and parallel to the majority of the adjusting plate. In this manner there is sufficient room for resilient bending of the switching element during operation of the relay without the switching element contacting the parallel adjusting plate.

In order to increase the ability of the externally applied magnetic force to rotate the adjusting plate around the torsion bars, the adjusting plate may have its free end widened in the manner of a spade so as to accommodate as many magnetic power lines as possible. A reinforcing bead may be impressed along the center of the adjusting plate in order to strengthen the adjusting plate to insure that the plate itself will not be bent but rather that it will be rotated around the torsion bar connections during the magnetic adjustment.

In order for the outside guides of the adjusting plate to be more readily inserted into the housing slots, the ends of the guides, which may also be ribbed, may be provided with bevels such that the guides are easily inserted into the grooves. The opposite ends may be widened providing insertion shoulders so that no bending movement will be applied to the guides during assembly. The adjusting plate can be attached to a carrier member, particularly through the guides with the carrier having a portion projecting at an angle to the remaining portions of the adjusting plate. The carrier may be attachable to a ferromagnetic housing cap. Thus, the carrier for the adjusting plate and the switching element are simultaneously components of the contact circuit. Thus, the adjusting plate carrier can be provided with a connection pin which can be formed in one piece with the remainder of the adjusting plate unit.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
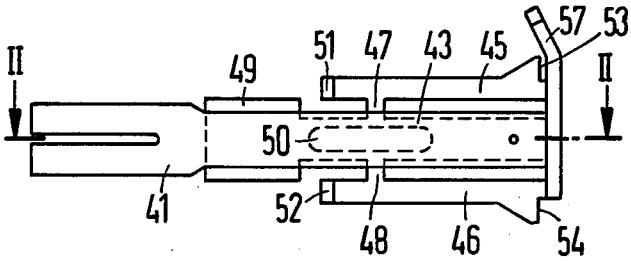
FIG. 1 is a plan view of the adjusting plate and switching element assembly of this invention.
Figure 3:
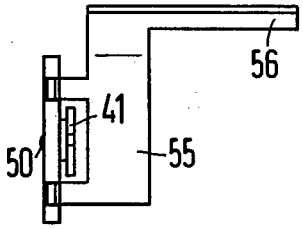
FIG. 3 is an in-plan view of the assembly of FIG. 1.
Figure 2:
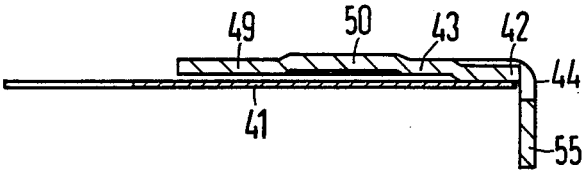
FIG. 2 is a cross sectional view taken along lines II--II of FIG. 1.

FIGS. 1 through 3 illustrate a switching element formed as a spring tongue 41. The tongue 41 is used in an armature contact with one end attached, by means such as welding, to an end 42 of an adjusting plate 43. The adjusting plate 43 is formed as a part of a ferromagnetic carrier 44 which comprises the adjusting plate 43 and two spaced guides 45 and 46 which parallel the center portion or adjusting plate portion 43 of the overall unit or carrier 44. The guides 45,46 and plate 43 are somewhat fork shaped. The guides 45 and 46 are connected to the adjusting plate 43 by means of cross pieces or torsion bars 47 and 48 positioned approximately centrally along the length of the adjusting plate portion 43.

The end 42 of the adjusting plate 43 to which the contact spring 41 is attached is bent downwardly, in FIG. 2, by means such as stamping so that the end 42 is off-set providing a space between the switching element 41 and the parallel portions of the adjusting plate 43. The free end 49 of the adjusting plate may be widened as best illustrated in FIG. 1, to form a spade-like end so as to provide a large area to receive the power lines from a magnetic adjusting device. A reinforcing bead 50 may be impressed in the center portion of the adjusting plate 43 to strengthen the longitudinal extent of the adjusting plate to assure that bending will occur at the torsion bars 47, 48.

The guides 45 and 46 may be provided with beveled ends 51, 52 in order to be easily insertable into guide grooves of the relay housing. Additionally, the guides may be ribbed and be provided with press-in shoulders 53, 54 at the opposite ends which are formed by widened portions of the guides 45, 46. In this manner, bending movements will be avoided when the carrier 44 is pressed into the relay housing. Such bending movements could otherwise occur due to pressing on the bent-off end 55. The bent-off or downwardly, in FIG. 2, end 55 is provided for coupling of the carrier 44 to a ferromagnetic housing cap. The end, moreover, is provided with an outwardly extending connection pin 56 which is directed towards the exterior of the relay housing to form a plug or solder connection and which is brought to the desired raster gauge by means of a bent portion 57 so as to be properly insertable in a base or other component.

Figure 4:
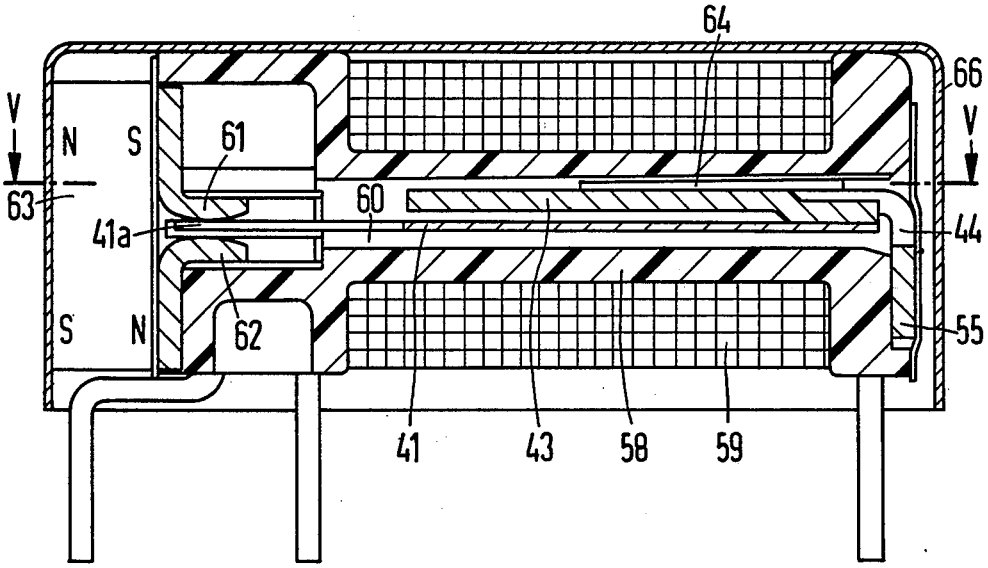
FIG. 4 is a cross sectional view of miniature electromagnetic relay equipped with the adjusting plate of FIGS. 1 through 3.
Figure 5:
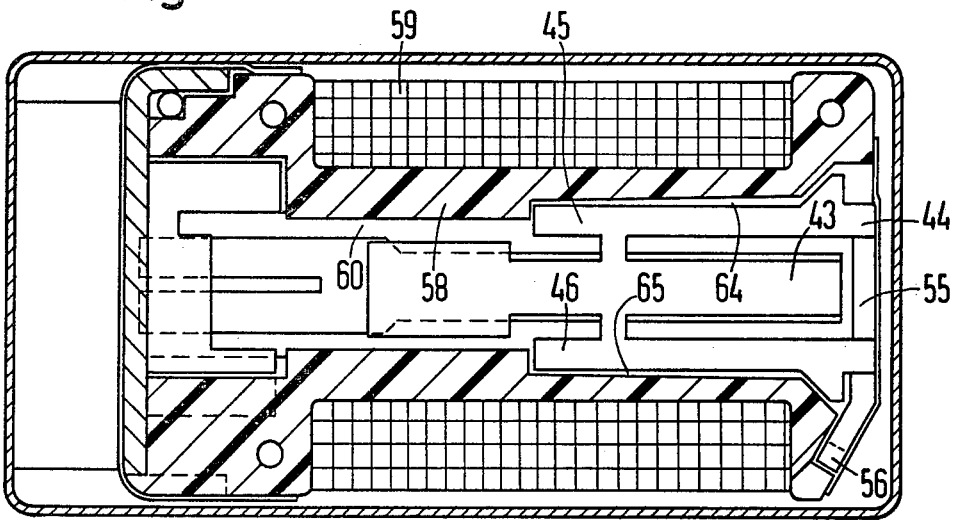
FIG. 5 is a view similar to FIG. 4 taken along the lines V—V of FIG. 4.

FIGS. 4 and 5 illustrate, in cross section, a completed relay equipped with the carrier 44 and switching element 41 of this invention. A coil body 58 is provided as a housing carrying an external coil 59 and defining a contact space 60 into which the carrier 44 projects. The switching element 41 used as an armature contact and is positioned with its free end 41*a* between two pole plates 61 and 62, which are magnetically coupled to a permanent magnet 63. The carrier 44 for the adjusting plate 43 and switching element 41 is inserted into grooves 64 and 65 formed in inside faces of the coil body 58. Suspension of the adjusting plate 43 is by means of the guides 45 and 46 which are snugly received in the grooves 64 and 65. The carrier is magnetically coupled to a ferromagnetic housing cap 66 through its bent end 55.

Figure 6:
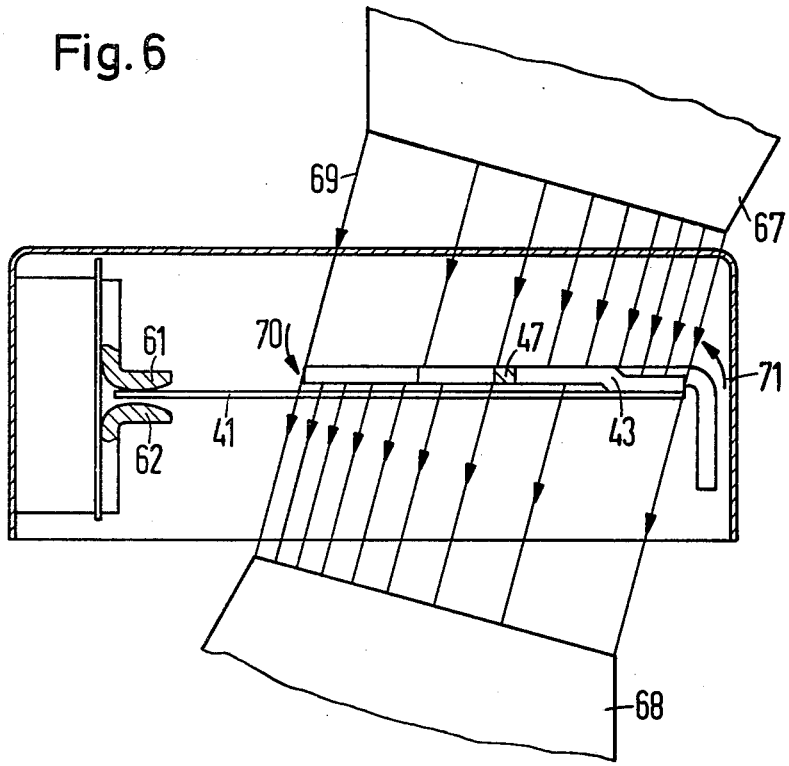
FIG. 6 is a diagrammatic sectional view of the relay of FIG. 4 illustrating the application of a magnetic force to cause bending of the adjusting plate around the torsion bar cross pieces.

FIG. 6 diagrammatically illustrates the adjusting process by which the positioning of the switching element 41 is adjusted from exterior of the completed relay. After assembly of the carrier 44, the adjusting plate 43 and the switching element 41 in the relay and after the switching space has been sealed, the position of the switching element 41 can still be adjusted. For this purpose, a magnetic field can be applied from externally located poles 67, 68. The magnetic field has field lines running across the adjusting plate 43 which therefore exert a magnetic force upon the adjusting plate. By proper application of the magnetic field and by proper adjustment of the poles 67, 68 the field can cause a rotation of the adjusting plate 43 about an axis of a rotation formed by the torsion bars 47, 48. The arrows 70 and 71 illustrate the direction of rotation. In this manner, the free end 41*a* of the switching element 41 can be brought to an arbitrary position between the counter-pole plates 61 and 62. By providing the cross pieces 47 and 48 of a material which will accept a torsional twist and thereafter maintain the achieved state, it can be assured that the positioning of the switching element 41 can be accurately adjusted. The desired positioning of the switching element can be sensed by external means including by controlled operation of the relay during the adjusting process.

It can therefore be seen from the above that our invention provides an improved magnetically adjustable electromagnetic relay wherein the switching element is supported on an elongated ferromagnetic adjusting plate which is supported interiorly of a relay housing through torsion bar members which may, in the embodiment illustrated, project normal to the longitudinal extension of the adjusting plate. The torsion bar members are twisted by rotation of the adjusting plate under the influence of an externally applied magnetic force so as to adjust the positioning of the adjusting plate within the relay housing. The switching element is attached to the relay housing and its position is therefore adjusted along with the adjusting plate.

Although the teachings of our invention have herein been discussed with reference to specific theories and embodiments, it is to be understood that these are by way of illustration only and that others may wish to utilize our invention in different designs or applications.

We claim as our invention:

1. In an electromagnetic relay having a housing with a flexible switching element mounted therein, the switching element attached at one of its two ends to an elongated ferromagnetic adjusting plate, another of the switching element ends cooperating with a second contact element carried by the housing to form an electrical connection, the ferromagnetic adjusting plate being pivotable within the housing by application of an externally applied magnetic field, the ferromagnetic plate carried by the housing, the improvement of the ferromagnetic plate being suspended from the housing through torsion bar means, the torsion bar means forming at least one swivel axis about which the ferromagnetic adjusting plate is pivotable under the influence of the externally applied magnetic field, the torsion bar means being formed of a material which is bendable to a new positional state upon torsional rotation under application of the external magnetic field.

2. A relay according to claim 1 wherein the torsion bar means project laterally from the adjusting plate centrally of the adjusting plate along a longitudinal reach of the adjusting plate, the adjusting plate being elongated.

3. A relay according to claim 2 wherein the torsion bar means extend from the adjusting plate laterally thereof and are connected to support guides, the support guides being tightly carried by the housing.

4. A relay according to claim 3 wherein the support guides, torsion bars and adjusting plate are formed of a single piece of ferromagnetic material, the support guides extending longitudinally in spaced parallel relation to portions of the adjusting plate on two sides of the adjusting plate, the torsion bars extending between the adjusting plate and the support guides.

5. A relay according to claim 4 wherein the adjusting plate, torsion bars and support guides are formed from a common strip of sheet metal.

6. A relay according to claim 3 or 5 wherein the switching element is attached to the adjusting plate adjacent one end of the adjusting plate, the one end of the adjusting plate being off-set from remaining portions of the adjusting plate, the switching element extending in spaced parallel relation to portions of the adjusting plate from the one end.

7. A relay according to claim 6 wherein the adjusting plate has a free end opposite the one end, the free end being widened with respect to remaining portions of the adjusting plate whereby the free end is somewhat spade shaped.

8. A relay according to claim 3 or 5 wherein the adjusting plate is longitudinally stiffened to resist bending of the adjusting plate whereby adjustment of the position of the adjusting plate occurs through torsional rotation of the torsion bars.

9. A device according to claim 8 wherein the stiffening of the adjusting plate is by means of a raised longitudinally extending rib formed in the adjusting plate.

10. A relay according to claim 3 or 5 wherein the support guides are received in internal guide grooves formed in opposed inside faces of the relay housing, the grooves open adjacent one end of the relay housing, the support guides inserted into the grooves from the one end, the support guides having a leading end and a trailing end with the leading end being inserted into the grooves first, the trailing end being formed with abutment shoulders for application of a force for pressing the support guides into the relay housing in the grooves.

11. A device according to claim 10 wherein the support guides have beveled edges at their leading ends.

12. A relay according to claim 11 wherein the adjusting plate, torsion bars and support guides form a carrier for the switching element, the carrier being provided with a trailing end adjacent the trailing end of the support guides, the trailing end having a portion thereof projecting in angle from remaining portions of the carrier, the portion forming an electrical connection pin.

13. In a miniature relay having a switching element affixed to a carrier assembly, the carrier assembly carried by a relay housing interior thereof, the switching element being resilient and the carrier assembly being formed, at least in part, of a ferromagnetic bendable material, the carrier assembly including an adjusting plate, the improvement of the carrier assembly having a centrally disposed elongated adjusting plate portion, spaced parallel extending guide portions and torsion bar interconnections between the adjusting plate portion and the guide portions, the torsion bar interconnections projecting laterally of the adjusting plate centrally thereof along the longitudinal extent of the adjusting plate, the guide portions carried by opposed internal side walls of the housing, the torsion bars being bendable.

* * * * *